US009808857B2

(12) United States Patent
Kilibarda et al.

(10) Patent No.: US 9,808,857 B2
(45) Date of Patent: Nov. 7, 2017

(54) CONTINUOUS FASTENER FEEDING APPARATUS AND METHOD

(71) Applicant: Comau, Inc., Southfield, MI (US)

(72) Inventors: Velibor Kilibarda, West Bloomfield, MI (US); William Maybee, Southfield, MI (US)

(73) Assignee: Comau LLC, Southfield, MI (US)

( * ) Notice: Subject to any disclaimer, the term of this patent is extended or adjusted under 35 U.S.C. 154(b) by 547 days.

(21) Appl. No.: 14/173,298

(22) Filed: Feb. 5, 2014

(65) Prior Publication Data

US 2014/0217227 A1 Aug. 7, 2014

Related U.S. Application Data

(60) Provisional application No. 61/761,050, filed on Feb. 5, 2013.

(51) Int. Cl.
*B21J 15/32* (2006.01)
*B21J 15/02* (2006.01)

(52) U.S. Cl.
CPC ..... *B21J 15/323* (2013.01); *B21J 15/025* (2013.01); *Y10T 29/5377* (2015.01)

(58) Field of Classification Search
USPC ..... 242/555.3; 221/104, 107
See application file for complete search history.

(56) References Cited

U.S. PATENT DOCUMENTS 3,189,293 A * 6/1965 Prager ..... B65H 19/1815 242/555.3
3,208,657 A 9/1965 Cohn
3,212,632 A * 10/1965 Baum ..... B25C 1/005 114/74 A
3,589,957 A 6/1971 Cohn
3,769,124 A * 10/1973 Johnson ..... B29C 53/32 156/159

(Continued)

FOREIGN PATENT DOCUMENTS

DE 19935853 A1 4/2000
GB WO 9301014 A1 * 1/1993 ..... B21J 15/02

OTHER PUBLICATIONS

Notification of Transmittal of the International Search Report and the Written Opinion of the International Searching Authority, or the Declaration, dated May 21, 2014.

(Continued)

*Primary Examiner* — Hemant M Desai
*Assistant Examiner* — Tanzim Imam
(74) *Attorney, Agent, or Firm* — Young Basile Hanlon & MacFarlane, P.C.

(57) ABSTRACT

Methods and apparatuses for continuous fastener feeding for sequentially delivering single fasteners to a fastener installation device are disclosed. In one embodiment the apparatus includes a first fastener reel for supporting a first fastener tape securing a plurality of fasteners and a second fastener reel for supporting a second fastener tape for securing a plurality of fasteners. A fastener tape joining device positioned downstream of the first and second fastener reels receives the respective first and the second fastener tapes and selectively engage the first and second fastener tapes when one of the fastener tapes becomes depleted of fasteners.

9 Claims, 11 Drawing Sheets

(56) References Cited

U.S. PATENT DOCUMENTS 4,004,683 A * 1/1977 Pomeroy ..... B65D 83/0472 206/3
4,392,291 A 7/1983 Iai
4,410,103 A * 10/1983 Fuhrmeister ..... B21J 15/10 221/225
4,673,142 A * 6/1987 Keene ..... B65H 19/1821 242/555.3
4,842,681 A * 6/1989 Bader ..... B65H 19/14 156/159
4,875,633 A * 10/1989 Mochizuki ..... B65H 19/1889 242/554.2
4,934,621 A * 6/1990 Jacobs ..... B65H 19/1815 242/554.6
5,136,873 A * 8/1992 Hopkins ..... B21J 15/043 29/243.521
5,253,819 A * 10/1993 Butler, Jr. ..... B65H 19/14 156/504
5,333,803 A * 8/1994 Planeta ..... B65H 16/106 242/555.3
5,339,983 A 8/1994 Caple
5,709,355 A * 1/1998 Kinnunen ..... B65H 19/181 242/555.3
5,762,284 A * 6/1998 Rautiainen ..... B65H 19/1815 242/555.3
5,931,298 A * 8/1999 Huang ..... F16B 27/00 206/346
6,164,489 A 12/2000 Altrock
6,301,948 B1 * 10/2001 Weiland ..... B21J 15/043 29/243.525
6,547,909 B1 * 4/2003 Butterworth ..... B65H 19/1836 156/157
6,554,220 B2 * 4/2003 Gambini ..... B65H 19/1836 242/554.2
6,792,987 B2 * 9/2004 Monroe ..... B65H 19/1852 156/351
7,135,083 B2 * 11/2006 Middelstadt ..... B26D 1/405 156/157
7,618,004 B2 * 11/2009 Gelli ..... B65H 19/1836 242/555
2003/0168548 A1 * 9/2003 Kinnunen ..... B65H 19/1821 242/555.3
2007/0108250 A1 * 5/2007 Odoni ..... B25C 1/003 227/107
2008/0210734 A1 * 9/2008 Uejima ..... B25C 1/003 227/2
2008/0230646 A1 * 9/2008 Morelli ..... B65H 19/1868 242/555.3
2008/0251559 A1 * 10/2008 Uejima ..... B25C 1/003 227/3
2009/0242686 A1 * 10/2009 Oelen ..... B65H 19/181 242/555.3
2011/0220676 A1 * 9/2011 Greenwood ..... B21F 33/00 221/69
2013/0001116 A1 * 1/2013 Lin ..... F16B 27/00 206/347

OTHER PUBLICATIONS

Stefan Niederer, "Reel Changes on the Fly", Rebuilders, 2012, web page at http://voith.com/en/twogether-article-33-en-27-reel-changes-on-the-fly.pdf.
Voith, "FlyingSplice for fully automatic reel change", May 27, 2013, video at http://www.youtube.com/watch?v=2niHex-hHN8.
European Search Report, EP Application No. 14749030.4, dated 7 Sep. 7, 2016.

* cited by examiner

CONTINUOUS FASTENER FEEDING APPARATUS AND METHOD

CROSS REFERENCE TO RELATED APPLICATIONS

This application claims priority benefit to U.S. Provisional Patent Application No. 61/761,050 filed Feb. 5, 2013, which is incorporated herein by reference in its entirety.

FIELD OF THE DISCLOSURE

The invention generally pertains to fastener delivery systems for high-volume assembly facilities.

SUMMARY OF THE DISCLOSURE

The present invention provides a device and process for continuously providing fasteners, for example self-piercing rivets, to a high-volume robotic vehicle assembly line. The invention greatly improves on the downtime and manpower requirements of conventional robotic rivet systems which frequently require manual reloading of the fastener feed systems to support the production build. The embodiments herein provide the benefit of a second source of fasteners that automatically provides fasteners when a first source is depleted. The first depleted source can then be replaced at any time during the life of the second source.

In one example, a continuous fastener feeding device for use in sequentially delivering single fasteners to a fastener installation device is disclosed. The feeding device comprises a first fastener reel for supporting a first fastener tape securing a plurality of fasteners and a second fastener reel for supporting a second fastener tape for securing a plurality of fasteners. A fastener tape joining device is included and positioned downstream of the first and second fastener reels operable to receive the respective first and the second fastener tapes and selectively engage the first and second fastener tapes when one of the fastener tapes becomes depleted of fasteners.

In another example, a rivet setting system for fastening a plurality of materials together using self-piercing rivets is disclosed. The rivet setting system comprises a self-piercing rivet gun for installation of rivets along an assembly line, a first fastener reel for supporting a first rivet tape securing a plurality of self-piercing rivets, a second fastener reel for supporting a second rivet tape for securing a plurality of self-piercing rivets, and a rivet reel support rack to retain the first and second fastener reels. The system also includes a fastener tape joining device positioned downstream of the first and second fastener reels, operable to receive the respective first and the second fastener tapes and selectively engage the first and second fastener tapes when one of the fastener tapes becomes depleted of rivets.

An example of a method for continuously feeding fasteners to a fastener installation device is also disclosed. The method comprises the steps of feeding a first fastener tape having a tail end from a first fastener reel through a tape joining device toward a fastener installation device, positioning a second fastener tape having a leading end in the tape joining device in spaced proximity to the first fastener tape, and selectively engaging the tail end of the first fastener tape to the leading end of the second fastener tape when the first fastener tape is depleted of fasteners wherein the second fastener tape begins supplying fasteners to the fastener installation device.

Additional features and functions are described below and illustrated in the accompanying drawings. Other features and functions known by those skilled in the art are included within the scope of the invention.

BRIEF DESCRIPTION OF THE DRAWINGS

The description herein makes reference to the accompanying drawings wherein like reference numerals refer to like parts throughout the several views, and wherein.

DETAILED DESCRIPTION

Referring to FIGS. 1-7, examples of a continuous feed rivet setting system 10 for installing a self-piercing rivet into a workpiece 11 are illustrated. Rivet setting system 10 may include an self-piercing rivet gun 12 operably connected to a programmable robot 14 for manipulating and controlling operation of rivet gun 12 for installation of rivets along an assembly line, for example a vehicle assembly line (not shown). Rivet gun 12 may include various configurations suitable for a particular application as known by those skilled in the art.

Figure 1:
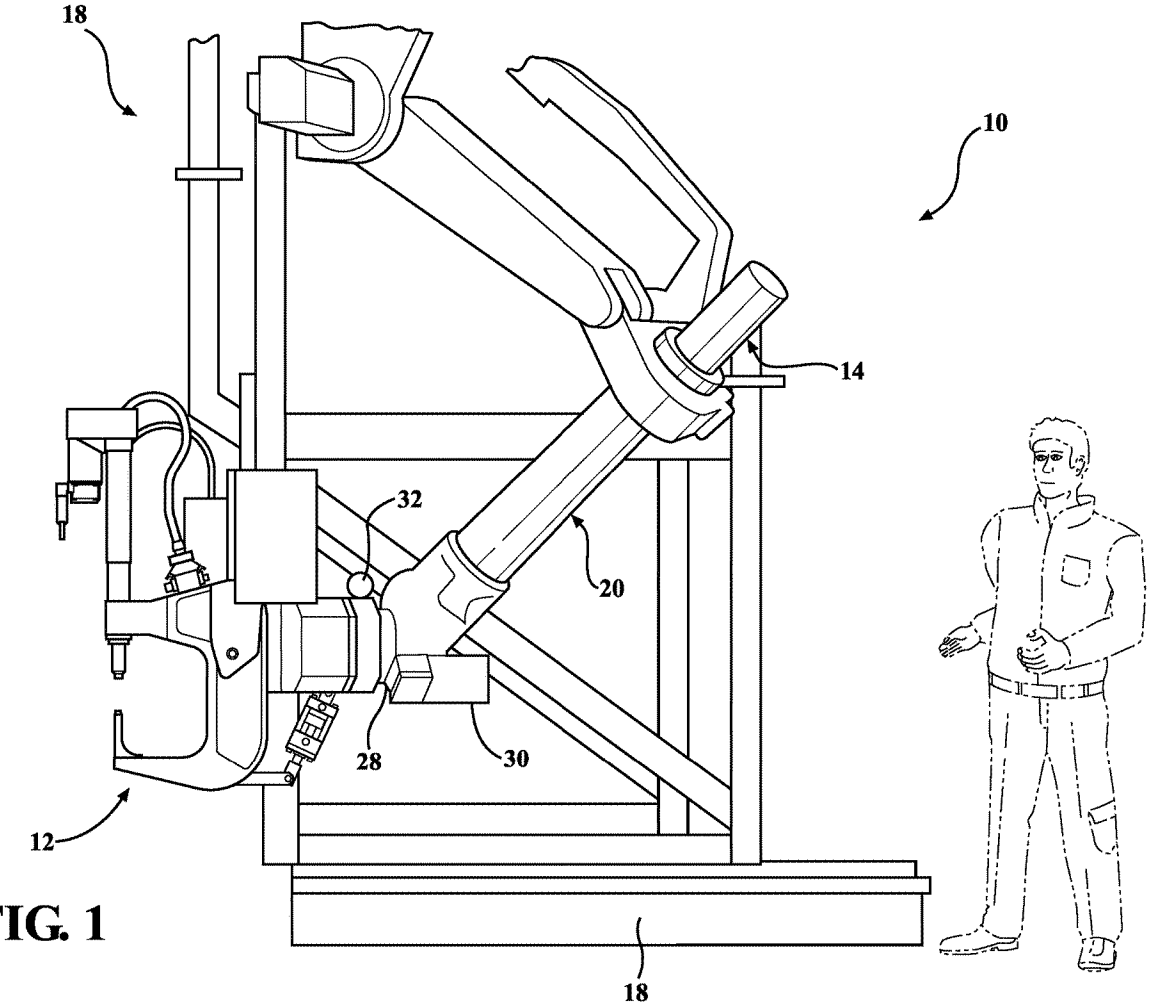
FIG. 1 is a side view of an example of an robotic self-piercing rivet gun assembly station positioned along an assembly line.

In the example shown in FIG. 1, robot 14 is suspended from a scaffolding structure 18. Further details of the scaffolding structure are included in U.S. Pat. No. 8,201,723 assigned to the assignee of the present invention, the entire contents of which is incorporated by reference. Structure 18 supports robot 14 articulating arm 20 including a wrist 28 attached to arm 20 and configured for enabling motion in multiple degrees of freedom. A drive mechanism 30 may be employed for selectively controlling operation wrist 28. Drive mechanism 30 may include one or more servo motors and other control devices. Rivet gun 12 may be attached to robot 14 by releasably engaging a connector face plate 32 attached to wrist 28 with a connector plate 33 on rivet setting device 16. Other robot and configurations and orientations to support and manipulate rivet gun 12 may be used as known by those skilled in the art. Other connection or mounting structures and methods between the rivet gun 12 and robot 14 known by those skilled in the art may be used.

Figure 2:
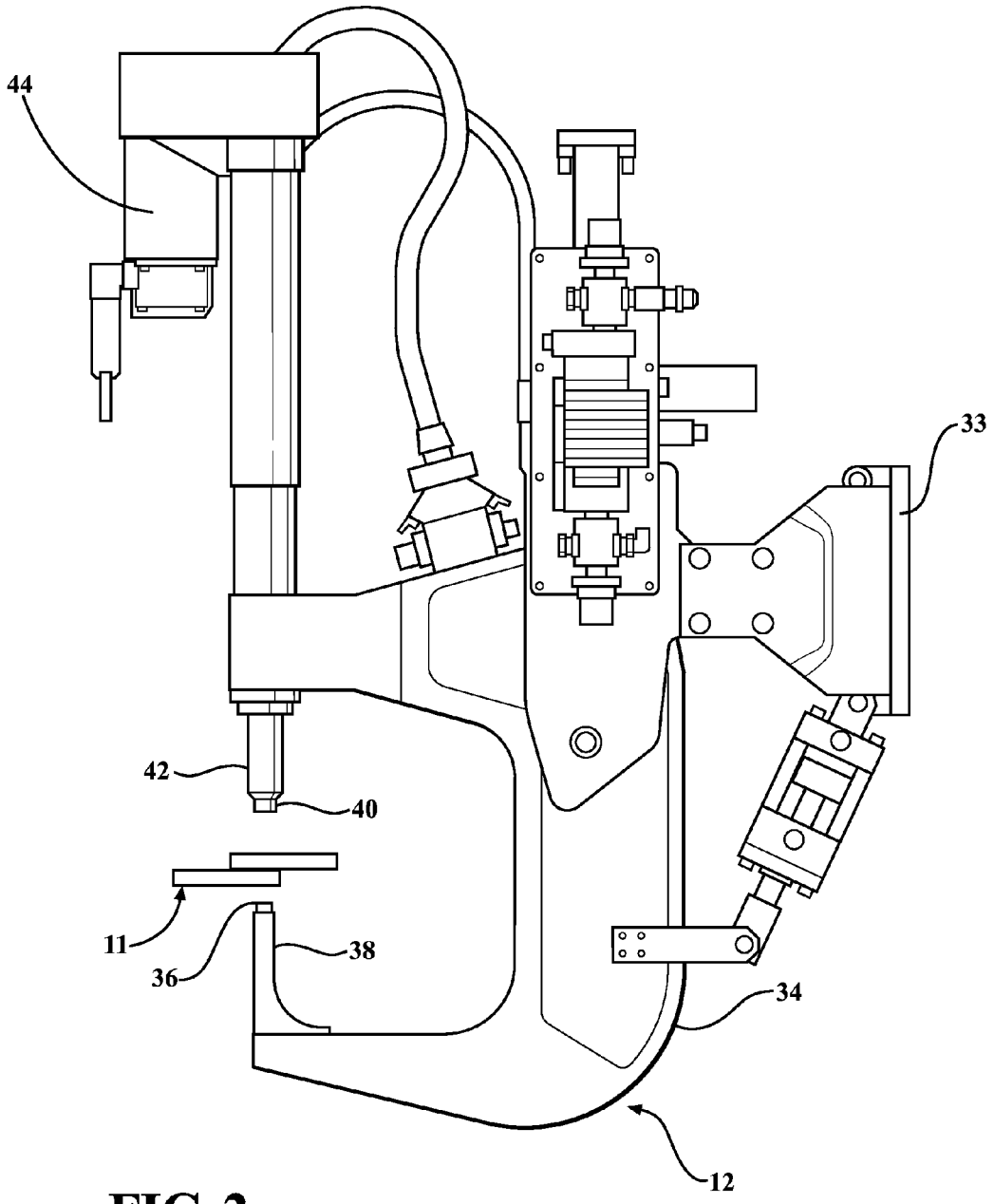
FIG. 2 is an enlarged side view of the self-piercing rivet gun shown in FIG. 1.

With reference to FIG. 2, an example of a self-piercing rivet gun 12 usable with the present invention is illustrated. In the example, rivet gun 12 may include a generally C-shaped frame 34 attached to connector plate 33 of rivet gun 16. A rivet die 36 may be mounted to one end 38 (a lower end in the illustrated exemplary configuration) of C-shaped frame 34. A rivet punch 40 may be mounted to an opposite end 42 (an upper end in the illustrated exemplary configuration) of C-shaped frame 34. Rivet punch 40 is positioned opposite rivet die 36 to enable rivet punch 40 to sequentially move in and out of contact with rivet die 36. A rivet punch drive mechanism 44 may be employed for forcibly moving rivet punch 40 toward and away from rivet die 36. Rivet drive mechanism 44 may include an electric drive motor, or another suitable drive mechanism, for apply an actuating force to rivet punch 40 to forcibly press a self-piercing rivet 46 held in rivet punch 40 into rivet die 36. Rivet drive mechanism 44 may also be used to retract rivet punch 40, for example, by reversing operation of the drive mechanism. Other configurations and operation of rivet gun 12 suitable for the particular assembly operation known by those skilled in the art may be used.

With particular reference to FIGS. 3 and 6A-C, a self-piercing rivet 46 generally includes a large diameter head 48 attached to a hollow shank 50 extending downward from the head. Rivet 46 is generally configured to be rotationally symmetrical. Shank 50 may include a central hollow cavity 52 that may be configured as a blind hole. A distal end 54 of shank 50 may include a beveled cutting edge 56. Other rivet structures and configurations known by those skilled in the art may be used.

Figure 3:
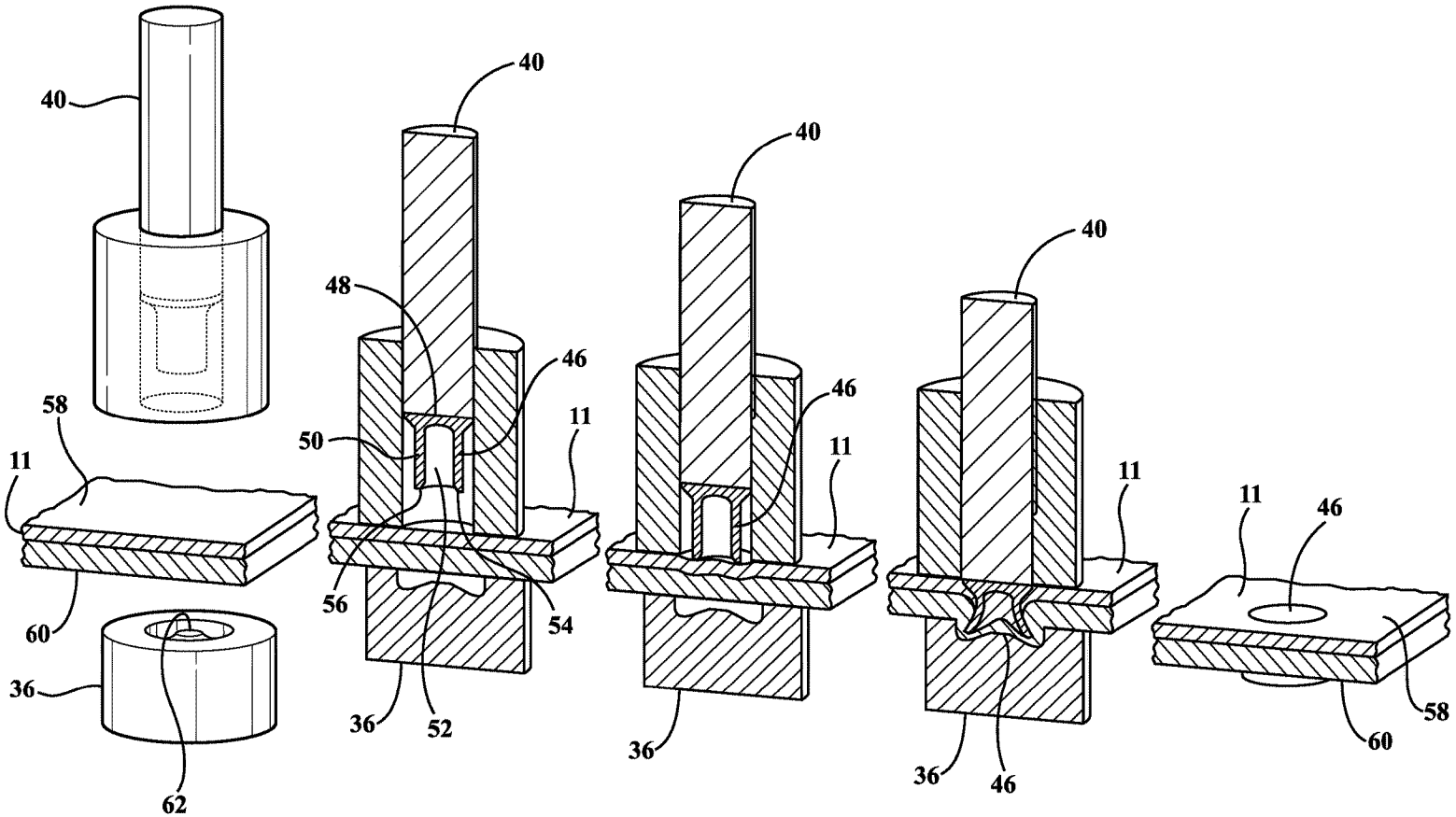
FIG. 3 is a schematic view of an example of a self-piercing riveting sequence.

FIG. 3 illustrates an exemplary process of using self-piercing rivet 46 driven by rivet punch 40 to mechanically join two panels 58 and 60 to form workpiece 11. Although the exemplary rivet joint illustrated in FIG. 3 includes two interconnected sheet metal panels, rivet 46 may also be used to connect a different number of sheets. Panels 58 and 60 may be relatively thin sheet materials, for example sheet steel or aluminum. The two panels 58 and 60 may be connected with rivet 46 by using punch 40 to apply a driving force to rivet head 48, which drives rivet 46 into the sheet metal panels. Distal end 54 of rivet 46 is sufficiently sharp to pierce the stacked sheet metal panels when subjected to the driving force applied by punch 40 acting on rivet head 48 to mechanically interlock the two sheets. Shank 50 of rivet 46 typically pierces punch side sheet 58, but generally does not pierce bottom die side sheet 60. Die 36 includes a cavity 62 for receiving portions of the fastened sheet metal panels 58 and 60 forced outward by shank 50 of rivet 46 driven in by punch 40. Shank 50 and the material of bottom die side sheet 60 immediately adjacent distal end 54 of shank 50 are deformed through the action of die 36 in order to mechanically interlock the two sheets 58 and 60. The exact configuration of die 36 will depend, at least in part, upon the shape of a button that is to be formed.

Figure 4:
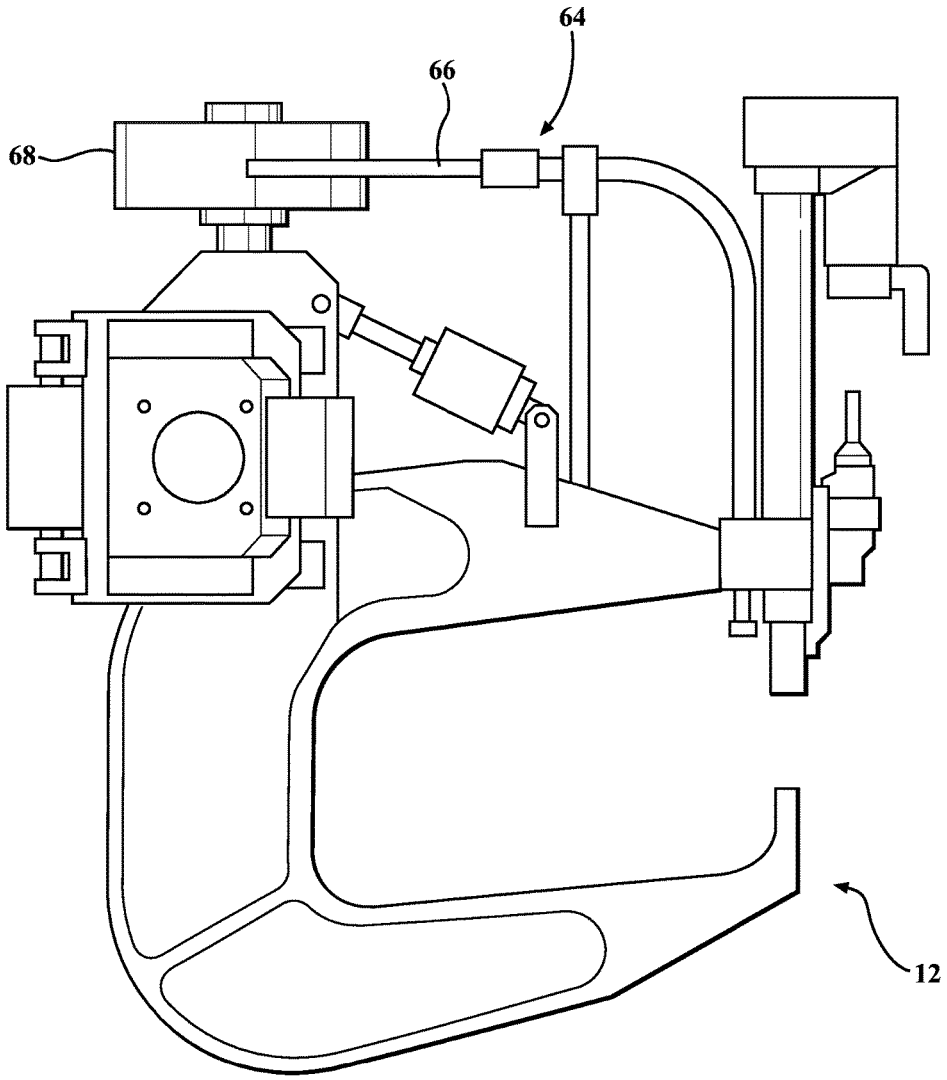
FIG. 4 is a schematic side view of an example of a conventional self-piercing rivet gun with a single rivet feed tape reel.
Figure 5A:
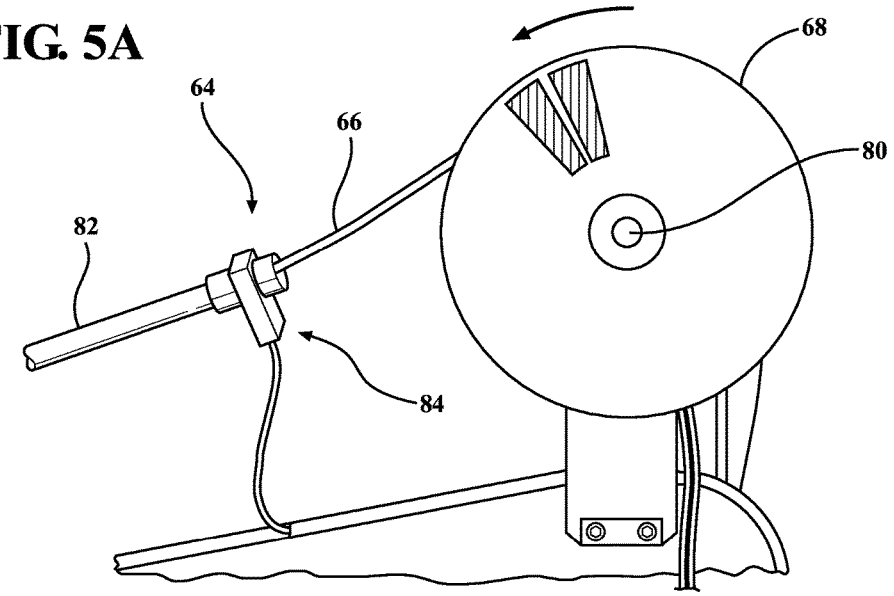
FIGS. 5A and 5B are side views of an alternate conventional rivet feeding device employing a single reel.
Figure 5B:
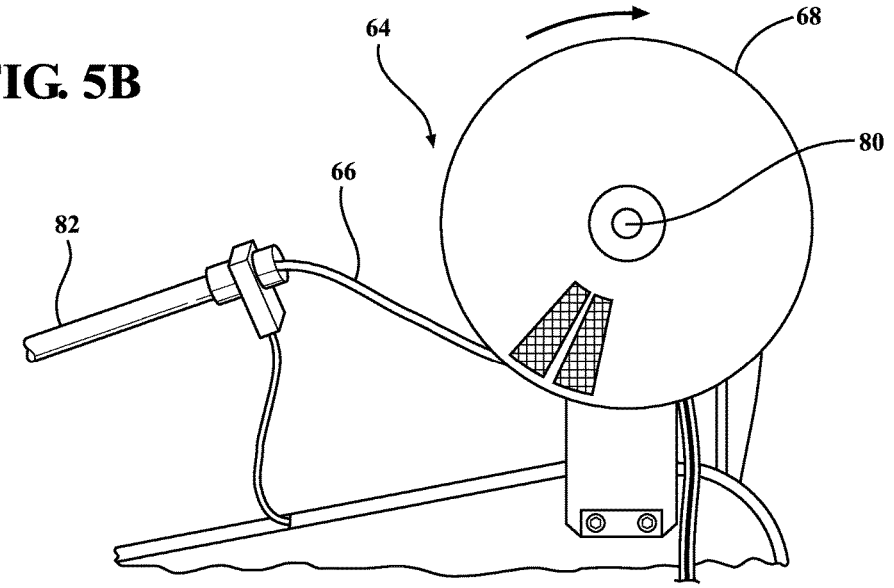

With reference to FIGS. 4 and 5, examples of a rivet tape feeder 64 may be employed for sequentially delivering single rivets 46 to rivet gun 12. Rivet feeder 64 may utilize an elongated flexible rivet carrier tape 66 for transporting rivets 46 from a rivet storage reel 68 to rivet gun 12. The example reel 68 is shown in a horizontal orientation in FIG. 4 and a vertical orientation in FIGS. 5A-B. Other forms of fastener or rivet reels 68 and their orientation to robot 14 and rivet gun 12 known by those skilled in the art may be used.

Figure 6A:
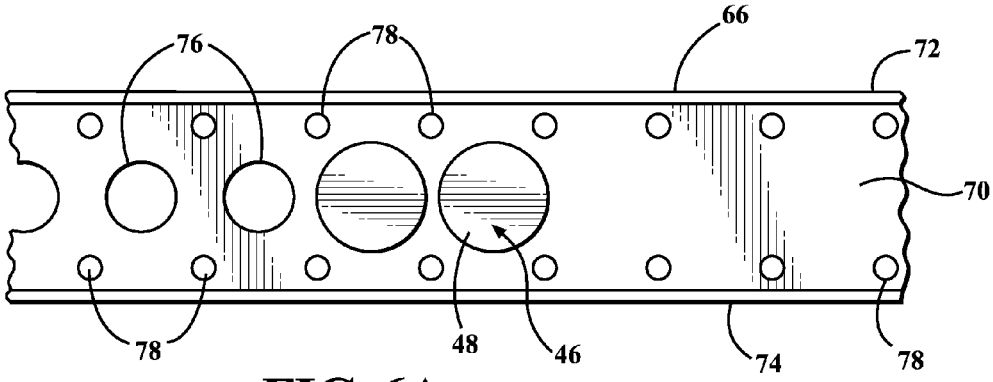
FIG. 6A is a top view of an example of a self-piercing rivet tape usable with the present invention.
Figure 6B:
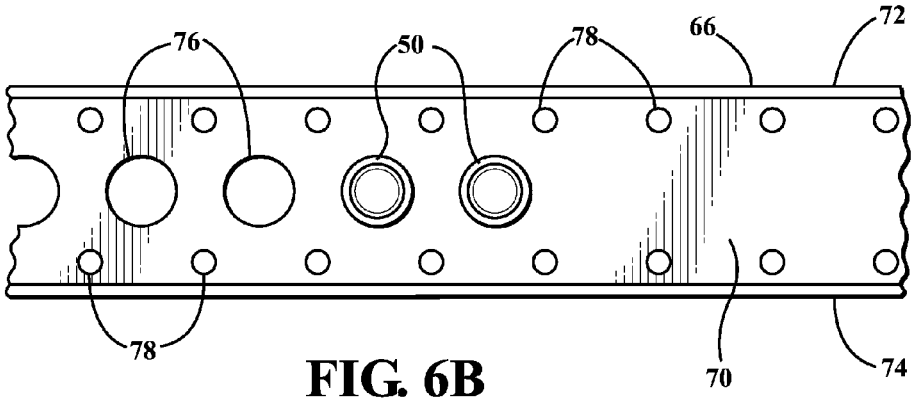
FIG. 6B is a bottom view of the rivet tape shown in FIG. 7A.
Figure 6C:
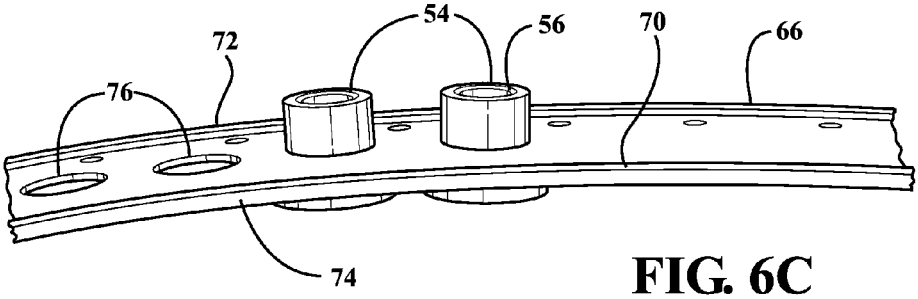
FIG. 6C is a front view of the rivet tape shown in FIG. 7B.

Referring to FIGS. 6A-C, an example of a rivet carrier tape 66 is shown. In the example, rivet carrier tape 66 may be made from an extruded polymer or elastomer material and includes a web 70 interconnecting parallel side flanges 72 and 74 arranged on opposite sides of web 70. Rivet carrier tape 66 may include a plurality of equally spaced apart apertures 76 arranged along a length of the tape for receiving and removably securing rivets 46. Apertures 76 may be undersize relative to a diameter of shank 50 of rivet 46 to securely retain rivets 46 on rivet carrier tape 66 prior to be installed into workpiece 11. Punch 40 may be sequentially actuated to drive each rivet 46 from rivet carrier tape 66 and into workpiece 11.

Rivet feeder 64 may be employed to feed rivet carrier tape 66 through rivet setting device 16 so that each rivet 46 becomes aligned with a path of punch 40 and is inserted by the punch into workpiece 11. Rivet carrier tape 66 may include drive apertures 78 positioned along the sides of web 70 adjacent side flanges 72 and 74. Drive apertures 78 may be engaged by pins on one or more drive sprockets (not shown) for feeding rivet carrier tape 66 into rivet setting device 16. Punch 40 may be actuated to sequentially drive each rivet 46 from rivet carrier tape 66 and insert the rivet into workpiece 11. Rivet feeder 64 may include an indexing mechanism (not shown) for sequentially feeding individual rivets 46 through rivet setting device 16.

Continuing to refer to FIGS. 5A and 5B, the exemplary storage reels 68 (a single reel shown in FIGS. 5A-B for ease of illustration only) may be configured generally as a spool and rotatably mounted to a shaft 80. Rivet carrier tape 66 dispensed from storage reel 68 may pass through a conduit 82 for guiding the rivet carrier tape into rivet setting device 16. Rivet feeder 64 may employ a top feed, as illustrated in FIG. 5A, and a bottom feed, as illustrated in FIG. 5B. Storage reels 68 may be rotated in a counterclockwise (as viewed from a perspective of FIG. 5A) to dispense rivet carrier tape 66 when employing the top feed arrangement, and storage container 68 may be rotated in a clockwise direction (as viewed from a perspective of FIG. 5B) to dispense rivet carrier tape 66 when employing the bottom feed arrangement.

With reference to FIGS. 7-11D, an example of a continuous feed rivet system employing two reels is shown. In the example rivet feeder 86 includes primary or first rivet supply reel 88 and a backup or second rivet supply reel 90. Primary reel 88 and backup or secondary reel 90 may be similarly configured as rivet storage reel 68 as previously described. In a preferred example, for example at the start of an assembly plant shift, each of the primary 88 and secondary 90 reels are stocked or wound with a supply of rivets 46 attached to rivet carrier tape 66. Depending on the fasteners and sizes used, hundreds or over a thousand rivets may be initially stored on each reel for selected delivery to rivet setting device 16 to support a high-volume production build.

Figure 7:
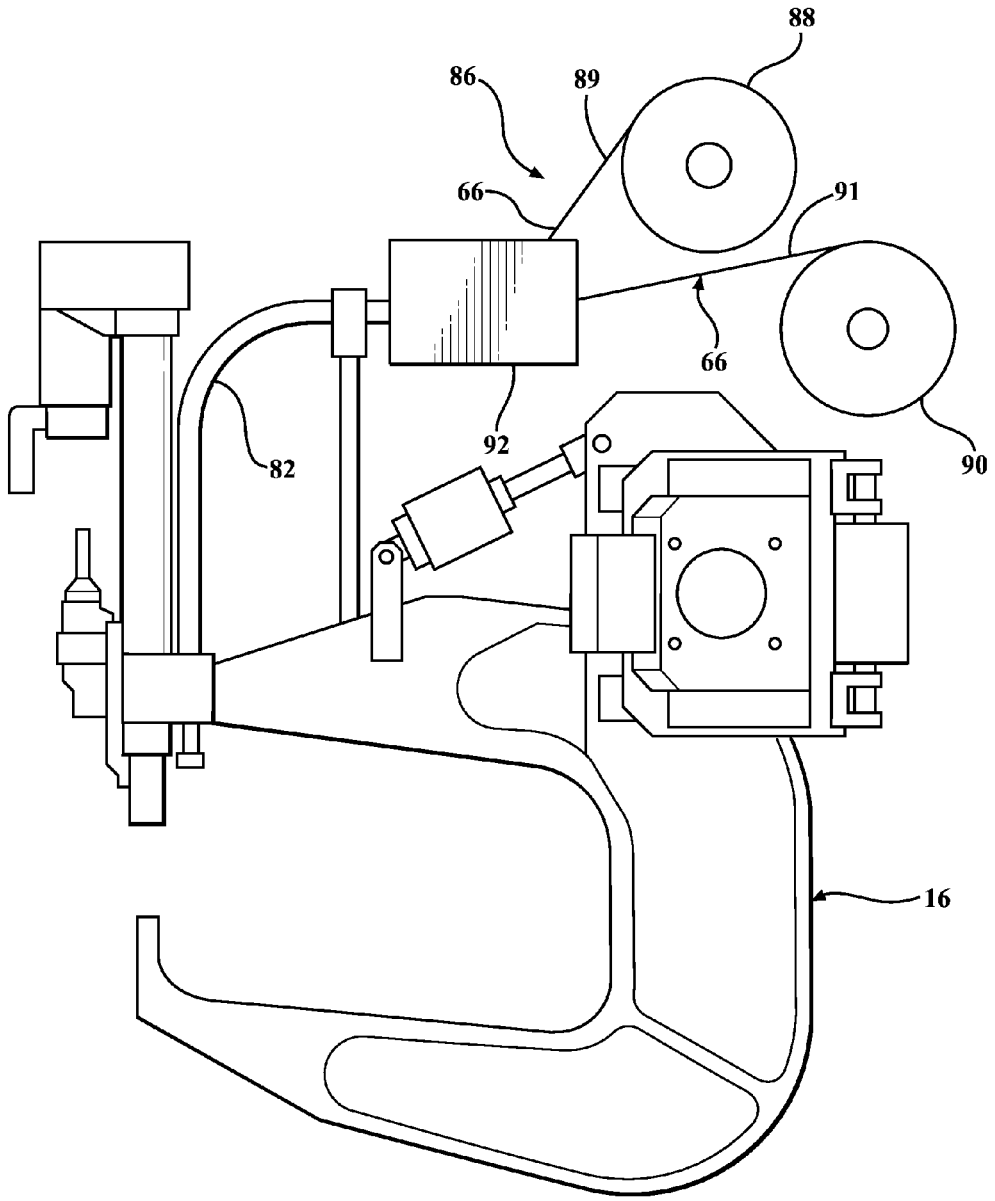
FIG. 7 is a schematic side view of an example of the present invention with two rivet feed reels and escapement device.
Figure 8:
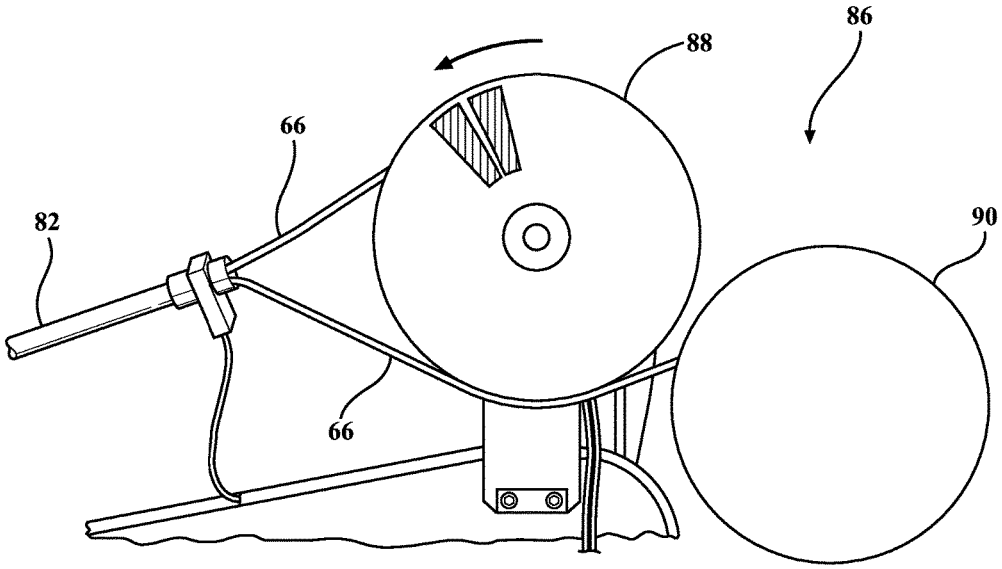
FIG. 8 is a schematic side view of an example of the present invention with two rivet feed reels.
Figure 9:
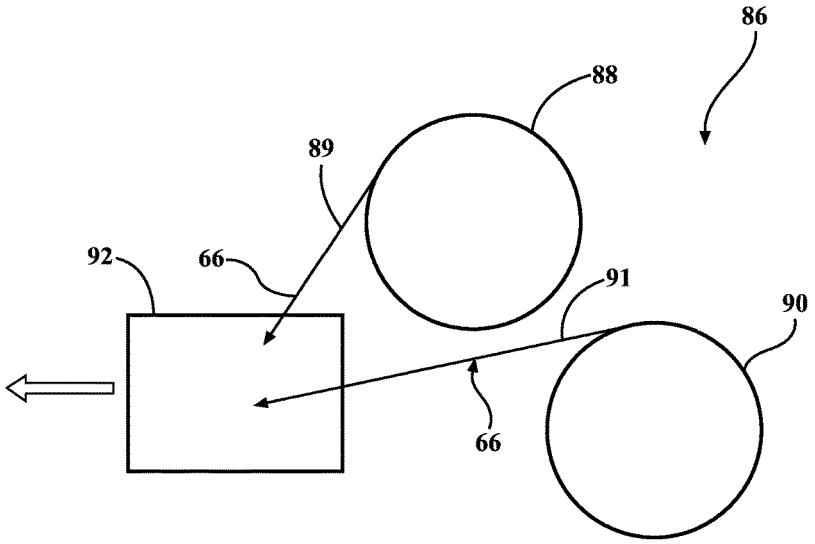
FIG. 9 is a schematic side view of an example of the present invention with two rivet feed reels.

In one example of system 10, each of the primary 88 and secondary 90 reels are mounted on a reel carrier (not shown) in a front-to-back orientation as generally shown in FIGS. 7-9. In this orientation, a primary rivet tape 89 carrying rivets 46 is aligned for feeding rivets to rivet gun 12 through selected movement of the tape by a driving devices as previously described. Secondary reel 90 is also positioned in general alignment for feeding a separate, secondary rivet tape 91 carrying rivets 46 to rivet gun 12 when the primary reel rivet supply is exhausted in the manner described below.

It is understood that the position and orientation of the primary 88 and second reels 90 may vary from the illustrated position depending on the packaging space available and the feed system used by the particular rivet gun 12 as known by those skilled in the art. Although two reels are shown, it is contemplated that more than two reels may be used depending on the assembly operation and fasteners that are required.

Figure 10A:
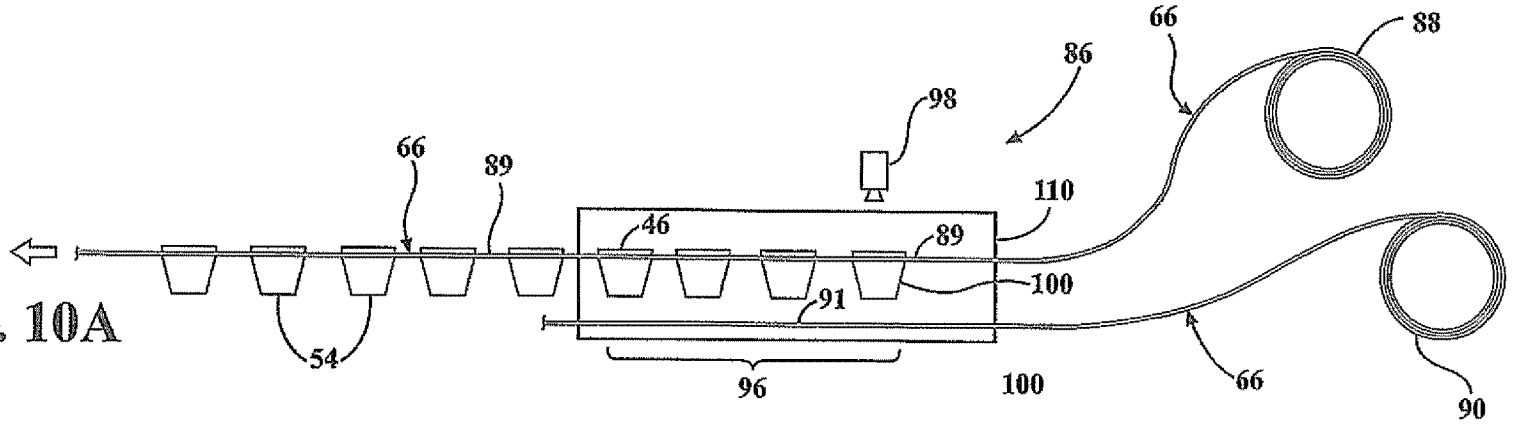
FIGS. 10A-D are schematic sequential and progressive process steps illustrating the transfer of feeding self-piercing rivets from a primary rivet feed reel to a secondary or backup feed reel.

Referring to FIGS. 10A-D, the example rivet setting system 10 includes a rivet carrier tape escapement or merging device 92 to guide and selectively link the first rivet tape 89 to the second rivet tape 91 for continuous supply of fasteners, preferably self-piercing rivets, to rivet gun 12. In the example escapement device 92, both of the first or primary rivet tape 89 and backup or secondary rivet tape 91 enter a first end in preferably longitudinal alignment, the first tape 89 positioned directly above the second tape 91 with a vertical space between the tapes as generally shown in FIG. 10A. In this orientation, rivets are selectively taken from primary reel 88 through advancement of first tape 89 through the escapement device 92 as previously described.

In the orientation shown in FIG. 10A, a lead section 96 of second rivet carrier tape 91 lies idle and does not advance toward the rivet gun 12. In a preferred example, lead section 96 of the second tape 91 does not include rivets 46 in several of the apertures 76 as generally shown in FIG. 6A (left side).

Figure 10B:
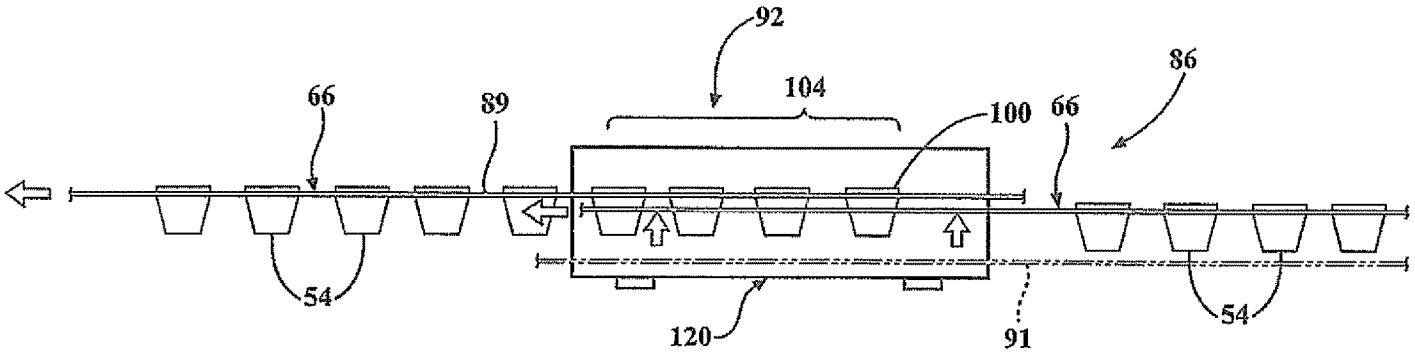

Referring to FIG. 10B, when the primary reel 88 is near depletion of rivets, a tail section 104 of the first tape 89 enters the escapement device first end 110. In a preferred example, the tail end includes several rivets 46 with the respective shanks extending downward in a direction toward the lead end of the second tape 91 positioned generally below the first tape as generally shown.

In the example, escapement device 92 includes a tape joining mechanism 120 which operates to selectively position lead section 96 of second tape 91 into engaging position with the tail section 104 of first tape 89 prior to the tail section 104 passing completely through the escapement device 92. In the example shown, tape joining device 120 can include a plate, rail or other component that supports and assists in alignment of second tape 91 in the position shown and described in FIG. 10A. When activated, joining device 120 may forcibly raise second tape 91 into contact with the protruding rivets 46 extending downward from the first tape 89 wherein the shanks 50 of one or more rivets 46 in the tail end 104 of the first tape engage respective apertures 76 in the second tape 91 to interlock the first 89 and second 91 tapes together such that the second tape 91 begins to advance toward rivet gun 12. In one example, tape joining device may be a pneumatically operated lift or servo motor operated device connected to a lower portion of the escapement device. Alternately, the elevated first tape 89 may be forcibly moved downward toward the second tape 91 positioned below in a similar manner. In another example (not shown), dual devices may simultaneously operate to lower the first tape 89 and raise the second tape 91 into engagement to "pinch" the two tapes into engagement. Other tape joining schemes, for example features on the tape substrate itself which may engage or interlock the tapes together, for example integrated hooks or catches molded into the tapes, known by those skilled in the art may be used. Further, alternate tape joining devices which physically move and position the tapes together known by those skilled in the art may be used.

Figure 10C:
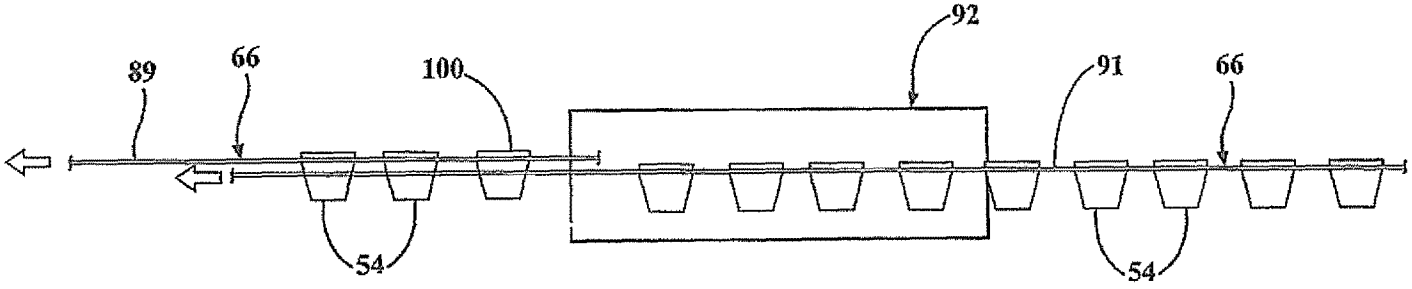
Figure 10D:
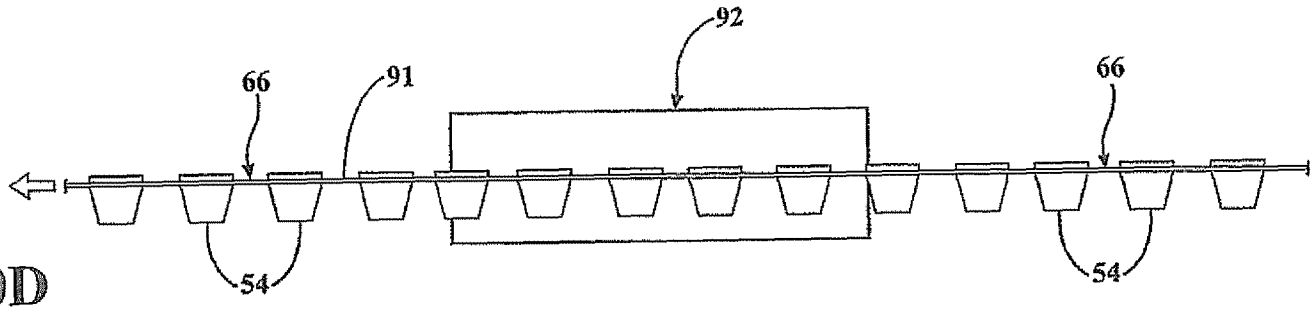
Figure 11B:
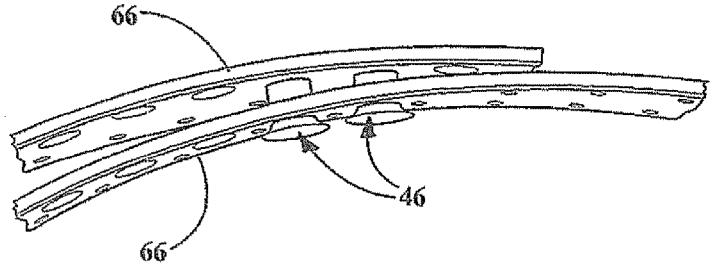
FIGS. 11A-D are alternate sequential and progressive steps showing an example of engagement between the trailing end of the primary rivet reel tape to the leading end of the secondary reel tape.
Figure 11D:
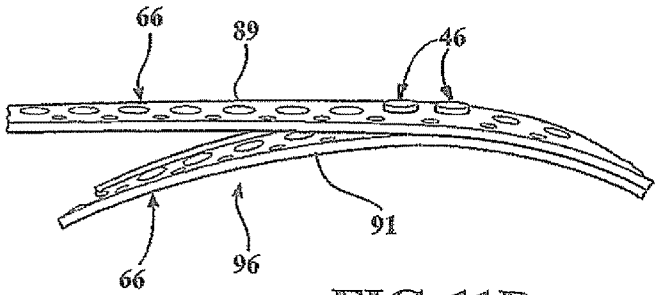
Figure 11A:
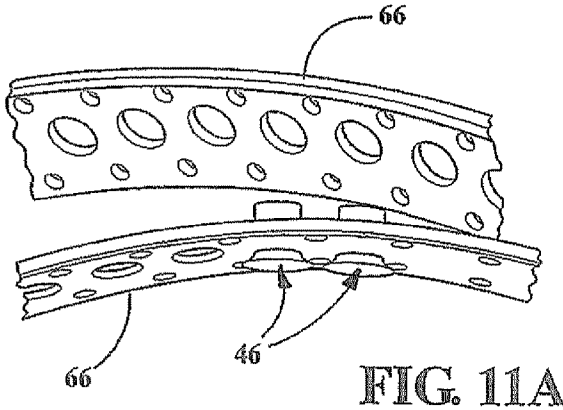
Figure 11C:
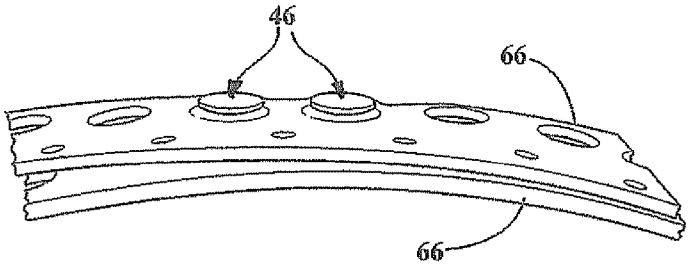

Referring to FIGS. 10C and D, on joining of the first tape 89 to the second tape 91 in one of the manners described, the second rivet reel 90 this is operable to provide a full stock of rivets to the rivet gun 12. In conventional fastener and rivet feed devices, the robot would have to be idled and the rivet reel replaced requiring manual intervention and a loss of valuable manufacturing time. In additional, much effort and time is spent on conventional devices attempting to track when a single reel or other rivet storage device would run empty. Often, in an attempt to minimize the robot downtime, conventional reels and cartridges would just be replaced before the fasteners were depleted which wastes the rivets.

As shown in FIGS. 5A and 10A, one or sensors 84, 86 may be used to monitor or detect the presence or absence of rivets or the movement of one or both of the reels 88 and 90. In one example shown in FIG. 10A, a sensor 98 may be employed to detect the presence of rivets 46 on the first tape 89 received from primary spool 88. Upon detecting a final trailing rivet 100 (or alternately detecting the absence of a rivet following the last rivet 100 on the tail end 104) on the first tape 89 from primary reel 88, sensor 98 may transmit a signal to a controller indicating that primary spool 88 is exhausted, or about to be exhausted, of rivets 46. The controller may then activate tape joining mechanism 120 in response to the signal received from sensor 98, instructing tape joining mechanism 120 to move lead section 96 of second tape 91 received from backup reel 90 into engagement with rivet carrier tape 66 received from primary spool 88, as illustrated, for example, in FIG. 10B. Alternate or additional sensors, for example vision systems, and other sensors and/or detectors, which are capable of providing electronic and/or visual notices or indicators to plant personnel of one or more conditions may be used as known by those skilled in the art.

As shown in FIG. 5A, an alternate or additional sensor 84 may be mounted to one or more of the primary 88 and second 90 reels which detects movement or stoppage of movement of the reels, for example when the primary 88 is depleted of rivets and stops rotating and/or the second reel 90 begins rotation signaling that the first reel 88 has been depleted and the rivet gun device is now operating on the second reel of rivets.

The controller (not shown) may be configured to send an electronic and/or visual signal to notify an equipment operator or maintenance personnel that primary reel 88 is exhausted of rivets 46 and should be replaced. By having the second reel 90 automatically and fully supporting the ongoing assembly operations, this provides the assembly plant significantly more time to replace the now depleted primary reel 88 providing for a continuous supply of rivets to the rivet gun 12 and greatly simplifies and improves the manual operations associated with the often hundreds of fastener robots that are deployed in large, high-volume vehicle assembly plants.

In one example not shown, the rivet reel support rack may include features to easily and quickly remove a depleted reel with a fully-stocked reel. In one example, the reel rack may also allow for the now feeding second reel 90 to be moved into the position of the depleted first reel which has been removed while the second reel 90 continues to feed rivets to the rivet gun 12. In the example where the rivet shanks are used to engage the tapes, this may be necessary to ensure that the lower or second reel 90 having a leading end with empty apertures 76 is positioned below the feeding reel so as to interlock the tapes as described above.

In yet another example, the second reel can remain in its original position and the rivet joining device 120 is adjusted to take into account that the lower reel is now feeding so as to forcibly push the leading edge of the upper tape into engagement with the lower feeding tape when the lower tape is almost depleted.

In a method or process for a continuous feed of fasteners or rivets, a sequence of sequential steps or processes using the above described components is used as described and illustrated. Additional steps may be added, steps may be removed and the order of steps may change as understood by those skilled in the art.

It is to be understood that the described and illustrated invention is not to be limited to the disclosed examples but, on the contrary, is intended to cover various modifications and equivalent arrangements included within the spirit and scope of the disclosure and appended claims which scope is to be accorded the broadest interpretation so as to encompass all such modifications and equivalent structures as is permitted under the law.

What is claimed is:

1. A method for continuously feeding fasteners to a fastener installation device through use of a fastener tape having a plurality of mechanical fasteners sequentially positioned along the tape and extending transversely thereto, the method comprising the steps of:

feeding a first fastener tape from a first fastener reel through a tape merging device toward a fastener installation device, the first fastener tape having a plurality of sequentially positioned mechanical fasteners extending transversely to the first fastener tape, the first fastener tape having a tail section, the tape merging device being partially closed and defining an interior cavity having a tape joining device positioned therein;

partially uncoiling a second fastener tape from a second fastener reel, the second fastener tape having a plurality of sequentially positioned mechanical fasteners extending transversely to the second fastener tape, the second fastener tape having a leading section, the leading section of the second fastener tape having no fasteners;

positioning the leading section of the second fastener tape in the tape merging device in spaced proximity to and in alignment with the first fastener tape;

the tape joining device engaging mechanical fasteners in the tail section of the first fastener tape with the leading section of the second fastener tape at an end of the first fastener tape so that the second fastener tape begins supplying mechanical fasteners to the fastener installation device.

2. The method of claim 1 further comprising moving the second fastener reel into a position of the first fastener reel after the first fastener reel is depleted of the first fastener tape.

3. The method of claim 1 wherein the first and the second fastener tapes each define a plurality of apertures sequentially positioned along the respective first and second fastener tapes, each of the mechanical fasteners selectively positioned in one of the apertures, and the step of engaging the mechanical fasteners in the tail section of the first fastener tape with the leading section of the second fastener tape at the end of the first fastener tape further comprises:

aligning the mechanical fasteners of the first fastener tape with apertures in the leading section of the second fastener tape in the interior cavity of the tape merging device; and forcibly moving one of the first or the second fastener tape toward the other of the first or the second fastener tape to engage the mechanical fasteners in the tail section of the first fastener tape with respective apertures in the leading section of the second fastener tape to interlock the first and the second fastener tapes together.

4. The method of claim 1 further comprising receiving, at a controller, a signal from at least one sensor indicative of a presence of the mechanical fasteners in the first or the second fastener tape.

5. The method of claim 1 further comprising a step of:

positioning the second fastener reel at a further distance from the tape joining device than the first fastener reel.

6. A method for continuously feeding mechanical fasteners to a fastener installation device, the method comprising the steps of:

feeding a first fastener tape through an elongate tape merging device defining an internal cavity containing a fastener tape path of travel toward a fastener installation device, the first fastener tape defining sequential apertures for receiving respective mechanical fasteners, the first fastener tape having a tail section and the elongate tape merging device including a tape joining device positioned in the internal cavity of the elongate tape merging device;

positioning a second fastener tape inside the internal cavity of the elongate tape merging device, in communication with the tape joining device, and in alignment with the first fastener tape, the second fastener tape defining sequential apertures for receiving respective mechanical fasteners, a leading section of the second fastener tape being devoid of the mechanical fasteners in the sequential apertures;

selectively engaging the tail section of the first fastener tape with the leading section of the second fastener tape to interlock mechanical fasteners of the tail section of the first fastener tape with sequential apertures in the leading section of the second fastener tape such that the second fastener tape begins supplying mechanical fasteners to the fastener installation device.

7. The method of claim 6 wherein the mechanical fasteners are rivets, and the step of feeding the first fastener tape further comprises a step of progressively uncoiling the first fastener tape from a first fastener reel.

8. The method of claim 6 wherein portions of the mechanical fasteners of the first fastener tape extend transversely from the first fastener tape in a direction toward the second fastener tape in the internal cavity of the elongate tape merging device, and the step of positioning the second fastener tape inside the internal cavity of the elongate tape merging device further comprises placing the leading section of the second fastener tape in a position in the internal cavity of the elongate tape merging device such that the portions of the mechanical fasteners of the first fastener tape which extend transversely from the first fastener tape are in alignment with respective of the apertures in the leading section sequential second fastener tape.

9. The method of claim 8 wherein the step of selectively engaging the tail section of the first fastener tape with the leading section of the second fastener tape comprises a step of:

the tape joining device forcibly moving the second tape in a direction transverse to the fastener tape path of travel into engagement with the first fastener tape until the portions of the mechanical fasteners of the first fastener tape which extend transversely from the first fastener tape extend through the respective sequential apertures in the leading section of the second fastener tape to thereby connect the first fastener tape with the second fastener tape.

* * * * *